US009266156B2

(12) United States Patent
Jepsen et al.

(10) Patent No.: US 9,266,156 B2
(45) Date of Patent: Feb. 23, 2016

(54) DEVICE AND METHOD FOR LATERAL GUIDANCE OF A ROLLED STRIP TRANSPORTED ON A ROLLER BED

(75) Inventors: Olaf Norman Jepsen, Siegen (DE); Peter Sudau, Hilchenbach (DE); Christian Mengel, Siegen (DE)

(73) Assignee: SMS GROUP GMBH, Düsseldorf (DE)

( * ) Notice: Subject to any disclaimer, the term of this patent is extended or adjusted under 35 U.S.C. 154(b) by 1150 days.

(21) Appl. No.: 13/126,629

(22) PCT Filed: Oct. 27, 2009

(86) PCT No.: PCT/EP2009/007679

§ 371 (c)(1),
(2), (4) Date: Jun. 7, 2011

(87) PCT Pub. No.: WO2010/049125

PCT Pub. Date: May 6, 2010

(65) Prior Publication Data

US 2011/0247380 A1 Oct. 13, 2011

(30) Foreign Application Priority Data

Oct. 28, 2008 (DE) ..... 10 2008 053 523
Mar. 20, 2009 (DE) ..... 10 2009 014 099

(51) Int. Cl.
*B21B 37/68* (2006.01)
*B21B 39/14* (2006.01)
(Continued)

(52) U.S. Cl.
CPC ..... *B21B 37/68* (2013.01); *B21B 39/14* (2013.01); *B21C 47/34* (2013.01); *B21C 47/3416* (2013.01); *B21D 43/023* (2013.01); *B21B 2273/04* (2013.01)

(58) Field of Classification Search
CPC .... B21B 39/14; B21B 37/68; B21C 47/3416; B21C 47/34; B65H 23/035; B21D 43/023
USPC ..... 72/250, 251; 226/3, 15–19, 24; 242/615.1, 534.1
See application file for complete search history.

(56) References Cited

U.S. PATENT DOCUMENTS 2,737,386 A * 3/1956 Reher ..... 226/17
5,284,284 A 2/1994 Narishima et al.
(Continued)

FOREIGN PATENT DOCUMENTS

DE 4003717 A 8/1991
DE 4129988 4/1992
(Continued)

*Primary Examiner* — Shelley Self
*Assistant Examiner* — Mohammad I Yusuf
(74) *Attorney, Agent, or Firm* — Lucas & Mercanti, LLP; Klaus P. Stoffel

(57) ABSTRACT

The invention relates to a device for lateral guidance of a rolled strip transported on a roller bed, particularly a hot rolled strip in front of a winding device (3), having parallel first and second side guides provided on both sides of the rolled strip, said side guides being movable toward or away from one another by adjusting means that are adjustable independently of one another; the invention is characterized in that a control device (14, 15, 16), to which operating forces and/or positions of the side guides and/or of the rolled strip can be fed as output values in the guidance of the rolled strip, is provided for damping the periodic deviation of the rolled strip, and in that the control device (14, 15, 16) controls the positions of the side guides and/or forces that the side guides exert on the rolled strip based on the measured output values.

6 Claims, 3 Drawing Sheets

(51) Int. Cl.
*B21C 47/34* (2006.01)
*B21D 43/02* (2006.01)

(56) References Cited

U.S. PATENT DOCUMENTS

| | | | | |
|---|---|---|---|---|
| 5,937,688 | A * | 8/1999 | Secen et al. | 72/202 |
| 6,000,259 | A * | 12/1999 | Wolters et al. | 72/13.3 |
| 8,291,736 | B2 * | 10/2012 | Schmidt | 72/10.3 |
| 8,490,447 | B2 * | 7/2013 | Kurz et al. | 72/8.1 |
| 8,616,034 | B2 * | 12/2013 | Tuschhoff | 72/10.4 |
| 8,616,035 | B2 * | 12/2013 | Tuschhoff | 72/14.4 |
| 2009/0113968 | A1 * | 5/2009 | Pawelski et al. | 72/14.1 |
| 2012/0174647 | A1 * | 7/2012 | Benner | 72/252 |

FOREIGN PATENT DOCUMENTS

| | | | | |
|---|---|---|---|---|
| DE | 4140784 | A | | 6/1993 |
| GB | 2276108 | A | | 9/1994 |
| JP | 3264111 | | | 11/1991 |
| JP | H05293528 | | | 11/1993 |
| JP | H05161906 | | | 6/1996 |
| JP | 8174064 | | | 7/1996 |
| JP | 11216516 | | | 8/1999 |
| JP | 2000254721 | | * | 9/2000 |
| JP | 2001047120 | | | 2/2001 |
| JP | 2006061934 | | | 3/2006 |
| JP | 2007125580 | | | 5/2007 |
| WO | 0230587 | A | | 4/2002 |

* cited by examiner

DEVICE AND METHOD FOR LATERAL GUIDANCE OF A ROLLED STRIP TRANSPORTED ON A ROLLER BED

The present application is a 371 of International application PCT/EP2009/007679 filed Oct. 27, 2009, which claims priority of DE 10 2008 053 523.0, filed Oct. 28, 2008, and DE 10 2009 014 099.9, 2008, filed Mar. 20, 2009, the priority of these applications are hereby claimed and these applications are incorporated herein by reference.

BACKGROUND OF THE INVENTION

The invention relates to a device for laterally guiding a rolled strip transported on a roller table, preferably a hot strip, in front of a coiling device, with parallel first and second lateral guides on both sides of the rolled strip which can be adjusted by independently adjustable means toward and away from each other.

The hot-rolled strip reels are arranged at the end of hot rolling trains and have the function of coiling the hot strip into coils after rolling. The strip is warmed while being subjected to tensile stress in order to achieve a sufficiently tightly wound coil and to produce strip with straight edges, and in order to prevent the coil from opening after the coil has been finished.

During coiling, under certain circumstances it may happen that the rolled strip is shifted periodically to the side. This may cause the amplitude to decrease, while the entire coiling process remains constant or increases. In particular in high-grade steel or at low coiling temperature, the periodic shifting can be observed. As a trigger for the beginning of the vibrations are in particular non-planar areas or so called "sabers" at the strip head, tension loss or other problems during the coiling process can be observed.

Due to the periodic shifting, the coiling quality suffers. The coil is not wound with straight edges, loose windings occur, and in extreme cases there may be instability or the coiling process has to be interrupted. During the periodic shifting, the rolled strip travels back and forth sinusoidally on the coil, in the driver and between the lateral guides. During this process, amplitudes of 50 mm or more can be reached on the coil. High forces occur in the lateral guides which can lead to edge damage and to buckling of the strip edge.

From DE 40 03 717 A1 is known a lateral guide for rolled strip which is being transported on a roller table, preferably hot strip in front of a reel. On both sides of the roll strip are already provided guide ruler or lateral guides which are shiftable toward each other or away from each other and which are coarsely prepositioned in a first step and can be pressed against the roll strip in a second step. For this purpose, hydraulic cylinders are used which are capable during the second step of applying the necessary contact pressure. The hydraulic cylinders cause the shifting of the guide rulers during the first as well as during the second step. For controlling the hydraulic cylinders, a regulating device is provided which during the first step pushes ahead the guide rulers out of a withdrawn initial position into a predeterminable position via the hydraulic cylinders arranged following as adjusting members. During the second step, at least one of the hydraulic cylinders is controlled with respect to position as well as to force.

WO 2002 030587 A1 also discloses a device for guiding a metal strip to a reel, wherein the lateral guide rulers are used. In the travel direction of the metal strip, a first and a second guide ruler is provided on each of the two sides. The positions of the second guide rulers relative to the metal strip are controlled independently of the positions of the first guide rulers by means of position regulators.

SUMMARY OF THE INVENTION

It is the object of the invention to provide an improved device for laterally guiding a rolled strip which is being transported on a roller table.

In accordance with the invention, this object is met in a device of the above-mentioned type by providing a regulating device for damping the periodic shifting of the rolled strip to which can be supplied as input values the forces acting during the guidance of the rolled strip and/or the positions of the guide rulers and/or the rolled strip, and the regulating device regulates, on the basis of the measured input values, the positions of the guide rulers and/or forces which are exerted on the lateral guides on the rolled strip.

At the core of the invention is the fact that a device for damping and avoiding the lateral shifting of the metal strip is provided. This stabilizes the coiling process. As an adjusting system, the lateral guides or guide rulers are used as adjusting system in the manner known per se in the area in front of the winding coils. The lateral guides can be adjusted perpendicularly in relation to the rolled strip in order to adapt their positions to the width of the strip being coiled.

Advantageously, a differential force between the two forces partially acting on the two guide rulers are obtained and then supplied to the regulating device.

An advantageous further development of the device, the forces of the driver adjustment to the roll strip and/or the positions of the driver adjustment relative to the roll strip are supplied as input variables to the regulating device.

In addition, it is advantageous to provide that the measured center strip position of the roll strip and/or a measured difference of the roll strip, particularly in the area of the reel, are supplied as input variables to the regulating device.

It is also advantageous if the control device includes a regulator to which can be supplied the forces which the two guide rulers act on the roll strip and to produce a distance signal for the two guide rulers.

In addition, it is advantageous if a first position regulator and a second position regulator are arranged following the regulator for the two sides of the rolled strip, wherein to the first position regulator can be supplied the sum of the distance signal produced by the regulator and the difference between the desired position value and the position value of the first guide ruler and to the second position regulator the difference from the distance signal produced by the regulator and the difference between the desired position value and the actual position value of the second guide ruler.

Preferably, the two position regulators produce desired valve values for hydraulic cylinders for actuating the guide signals or lateral guides.

The invention also relates to a method for laterally guiding a rolled strip which is transported on a roller table, preferably a hot rolled strip in front of a coiling device, with parallel first and second lateral guides arranged on both sides of the rolled strip, wherein the lateral guides can be moved toward each other or away from each other by the adjusting means, which are adjustable independently of each other.

In accordance with the invention, the method is characterized in that a regulating device dampens the periodic shifting of the rolled strip wherein to the regulating device as input values during the guidance of the roll strip are supplied the forces and/or positions of the lateral guides and/or rolled strip, and the regulating device regulates, on the basis of the measured input values, the positions of the lateral guides and/or forces which are exerted by the lateral guides on the rolled strip.

In the following, the invention will be explained in more detail in an embodiment.

DETAILED DESCRIPTION OF THE INVENTION

Figure 1:
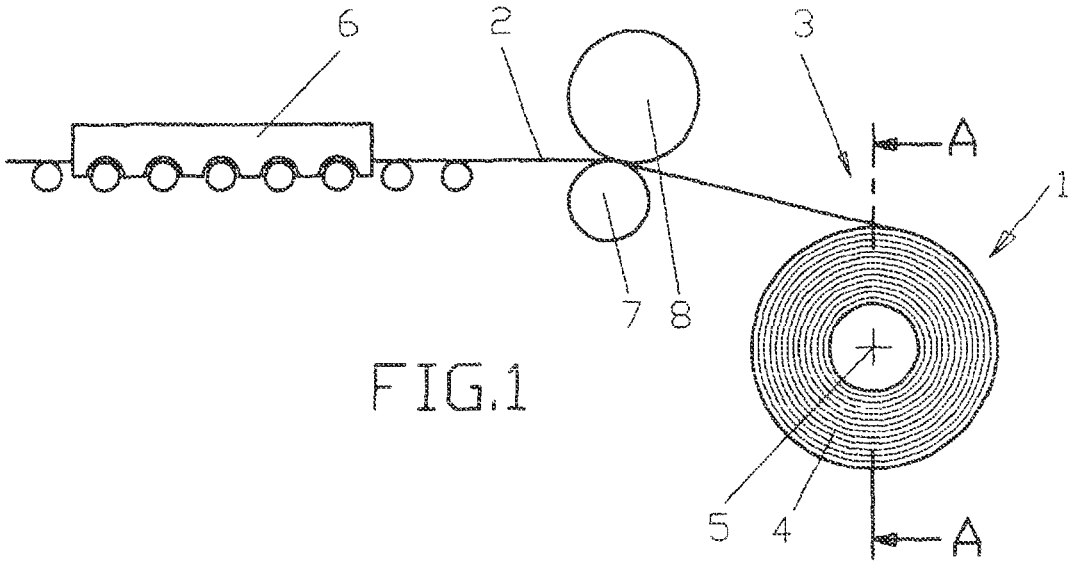
FIG. 1 is a top view of a front side of a metal strip reel with a device for supplying a metal strip to a coiling device, wherein the reel includes a lateral guide area.

A metal strip reel 1 (FIG. 1) serves for coiling a metal strip 2, particularly a hot strip, by means of a coiling device 3 onto which the metal strip 2 is to be coiled in the form of a coil 4 on a mandrel 5. The metal strip 2 is guided over a lateral guide area 6, pulled through a driver including a driver bottom roll 7 and a driver top roll 8, and finally is wound on the coiling device 3.

Figure 2:
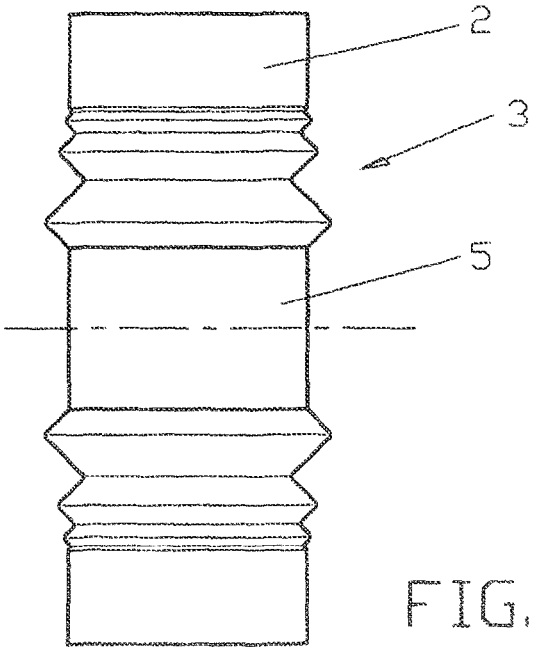
FIG. 2 is a schematically illustrated sectional view along a sectional line A-A of FIG. 1 through the winding device on which the metal strip has been coiled, wherein the lateral shifting of the metal strip during the winding procedure is periodic and descending.
Figure 3:
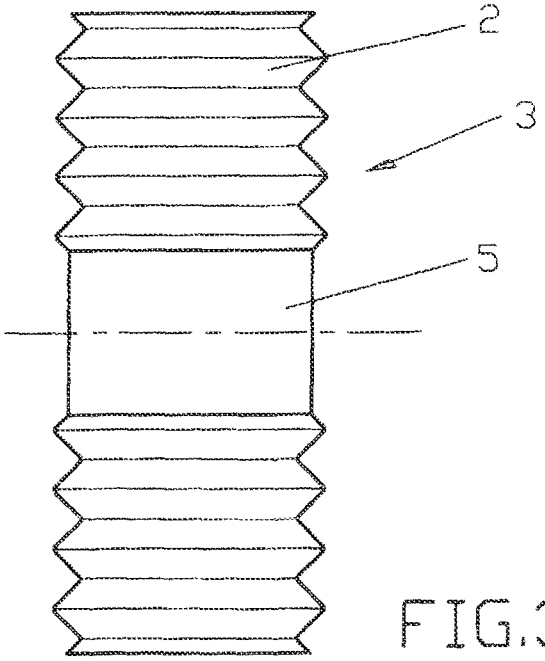
FIG. 3 is a schematically illustrated cross sectional view along a sectional line A-A of FIG. 1 through the coiling device on which the metal strip has been coiled, wherein the lateral shifting of the metal strip during the coiling process is periodic and continuous.
Figure 4:
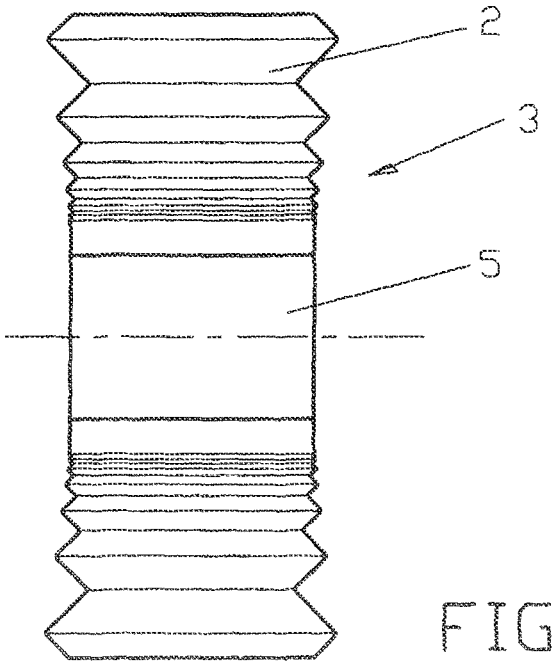
FIG. 4 is a schematically illustrated cross sectional view along a sectional line A-A of FIG. 1 through the coiling device on which the metal strip has been coiled, wherein the lateral shifting of the hot metal strip during the coiling process is periodic and increasing.

During the coiling process, it may happen under certain circumstances that the roll strip 2 is periodically laterally displaced, i.e., the metal strip 2 is not coiled centrally and with straight edges on the coiling mandrel 5 of the coiling device 3, but shifts laterally from the middle position. For example, periodic deviations occur from the middle position on the coiling mandrel 5. The amplitude of the lateral offset of the metal strip 2 relative to the desired middle position during the winding process may descend (FIG. 2), while the entire coiling process remains constant (FIG. 3), or increase during the coiling process (FIG. 4).

Figure 5:
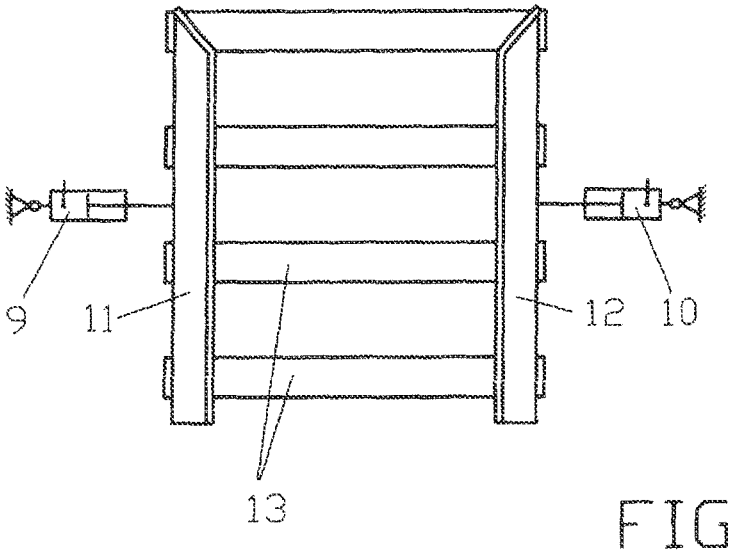
FIG. 5 is a top view of the upper side of the lateral guide area according to FIG. 1 with hydraulically adjustable lateral guide elements and FIG. 6 shows an embodiment for a regulation for damping the periodic shifting.

In accordance with the invention, the metal strip reel 1 has in the lateral guide area 6 (FIG. 5) on both sides, i.e., on the operating side as well as on the drive side, hydraulically actuated adjusting cylinders 9, 10 for being able to adjust lateral guides 11, 12 in accordance with the desired position of the metal strip 2, wherein the adjusting cylinder 9 is arranged on the operating side and the adjusting cylinder 10 is arranged on the drive side. The metal strip travels in this area over rollers 13.

In accordance with the invention, the following variables are included in the regulating procedure:

$F_{SBS}$ Force of lateral guide 11 on the operating side on the lateral edge of the metal strip 2, $F_{SAS}$ Force of the lateral guide 12 on the drive side against the lateral edge of the metal strip 2, $\Delta S_D$ Differential position as additional desired value, $S_{BSREF}$ Desired position value of lateral guide 11 on the operating side $S_{BSACT}$ Actual position value of the lateral guide 11 on the operating side, $S_{ASREF}$ Desired position value of lateral guide 12 on the drive side, $S_{ASACT}$ Actual position value of the lateral guide 12 on the drive side, $y_{VAS}$ Desired valve value of a valve of the adjusting cylinder 9 on the operating side, and $y_{VBS}$ Desired valve value of a valve of the adjusting cylinder 10 on the drive side.

Figure 6:
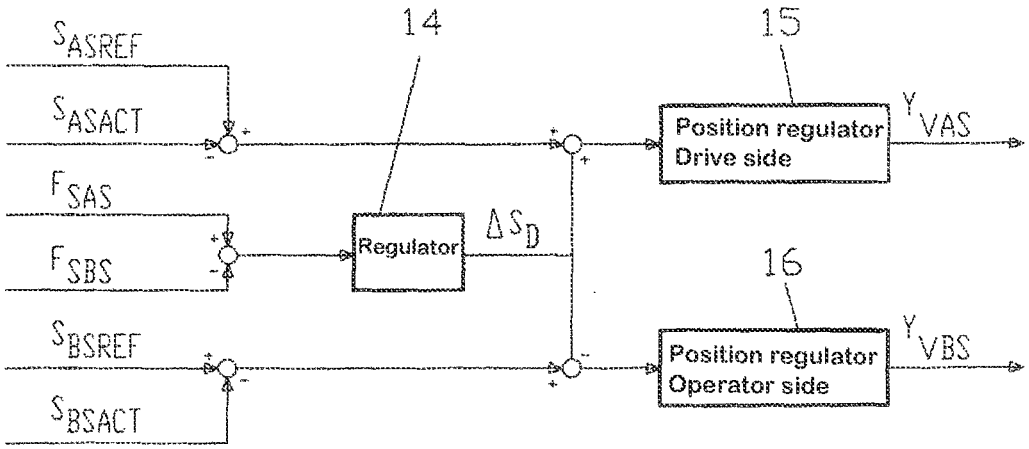

Supplied to a regulator 14 (FIG. 6) are the two force values $F_{SBS}$ of the lateral guide 11 on the operating side and $F_{SAS}$ of the lateral guidance 12 on the drive side as input values. The regulator 14 obtains from the difference a position value, namely the differential positions $\Delta S_D$. On the other hand, from the difference of the desired position value $S_{ASREF}$ of the lateral guide 12 and the position actual value $S_{ASACT}$ of the lateral guide 12, a first position value is obtained which is summed up with the value $\Delta S_D$ and is fed to a position regulator 15 for the drive side which produces therefrom the desired value $y_{VAS}$ in order to actuate the adjusting cylinder 9.

On the other hand, the value $\Delta S_D$ obtained from the regulator 14 is subtracted from a second position value which is produced from the difference of the desired position value $S_{BSREF}$ of the lateral guide 11 and the actual position value $S_{BSACT}$ of the lateral guide 11. The value produced by the subtraction of the value $\Delta S_D$ is supplied to a position regulator 16 for the operator side which produces therefrom the desired valve value $y_{VBS}$ in order to actuate the adjusting cylinder 10. In this manner, an individual control of the positions of the two adjusting cylinders 9, 10 is made possible.

LIST OF REFERENCE NUMERALS

1. Metal strip reel
2. Metal strip
3. Coiling device
4. Coil
5. Coiling dome
6. Lateral guidance area
7. Driver lower roller
8. Driver upper roller
9. Adjusting cylinder
10. Adjusting cylinder
11. Lateral guide
12. Lateral guide
13. Rolls
14. Regulator
15. Position regulator
16. Position regulator

The invention claimed is:

1. A device for laterally guiding a rolled strip transported on a roller table in front of a coiling device, comprising: parallel first and second lateral guides provided on both sides of the rolled strip, the lateral guides being moveable toward each other or away from each other; independently adjustable adjusting means for moving the lateral guides; and a regulating device for damping periodic shifting of the rolled strip, the regulating device being supplied with input values, the input values representing forces acting during guidance of the rolled strip and positions of the lateral guides and/or the rolled strip, the regulating device being operative to regulate based on measured input values of positions of the lateral guides and forces the lateral guides exert on the rolled strip, wherein the regulating device includes a regulator which is operative to produce respective distance signals for the two lateral guides from the forces which the two lateral guides exert on the roll strip, wherein a force difference ($F_{SAS}-F_{SBS}$) obtained from forces acting on the two lateral guides is supplied to the regulating device, which determines a differential position value from the force difference, wherein the regulating device further includes a first and a second position regulator arranged following the regulator for the two sides of the roll strip, wherein a sum of the differential position value produced by the regulator and a difference between the desired position value and the actual position value of the first lateral guide is supplied to the first position regulator, and a difference of the differential position value produced by the regulator and a difference between the desired position value and the actual position value of the second lateral guide is supplied to the second position regulator, whereby individual control of the adjusting means on both sides of the rolled strip is provided.

2. The device according to claim 1, wherein forces exerted on the roll strip by adjustment of a driver and/or positions of the adjustments of the driver to the roll strip are supplied to the regulating device as input values.

3. The device according to claim 1, wherein a measured strip center position of the rolled strip and/or a measured differential tension of the roll strip is/are supplied to the regulating device as input values.

4. The device according to claim 1, wherein the adjusting means includes hydraulic cylinders for actuating the lateral guides.

5. The device according to claim 4, wherein the first and second position regulators each produce desired valve values for the hydraulic cylinders for actuating the lateral guides.

6. A method for laterally guiding a rolled strip transported on a roller table in front of a reeling device, comprising the steps of: providing parallel first and second lateral guides on both sides of the roll strip; moving the lateral guides toward each other or away from each other with independently adjustable adjusting means; damping periodic shifting of the rolled strip with a regulating device; supplying to the regulating device as input values forces acting during guidance of the rolled strip and positions of the lateral guides and/or of the rolled strip; and, based on the measured input values, regulating with the regulating device the positions of the lateral guides and/or forces the lateral guides exert on the roll strip, wherein the regulating step includes producing respective distance signals for the two lateral guides from the forces which the two lateral guides exert on the roll strip, obtaining a force difference ($F_{SAS}-F_{SBS}$) from forces acting on the two lateral guides and supplying the force difference to the regulating device, determining a differential position value in the regulating device from the force difference, wherein the regulating device further includes a first and a second position regulator arranged following the regulator for the two sides of the roll strip, further including supplying a sum of the differential position value produced by the regulator and a difference between the desired position value and the actual position value of the first lateral guide to the first position regulator, and supplying a difference of the differential position value produced by the regulator and a difference between the desired position value and the actual position value of the second lateral guide is supplied to the second position regulator, whereby individual control of the adjusting means on both sides of the rolled strip is provided.

* * * * *